US008763531B2

(12) United States Patent
Silverman et al.

(10) Patent No.: US 8,763,531 B2
(45) Date of Patent: Jul. 1, 2014

(54) PYROTECHNIC ELECTRIC GENERATOR

(75) Inventors: Fredric Scott Silverman, Yorba Linda, CA (US); Gregory Arthur Lowe, Long Beach, CA (US); Gaybert Barnes Little, Jr., Redondo Beach, CA (US)

(73) Assignee: Hi-Shear Technology Corporation, Torrance, CA (US)

( * ) Notice: Subject to any disclaimer, the term of this patent is extended or adjusted under 35 U.S.C. 154(b) by 119 days.

(21) Appl. No.: 13/456,363

(22) Filed: Apr. 26, 2012

(65) Prior Publication Data

US 2013/0284042 A1 Oct. 31, 2013

(51) Int. Cl.

| | |
|---|---|
| ***F42D 1/045*** | (2006.01) |
| ***F42C 19/00*** | (2006.01) |
| ***F42B 3/12*** | (2006.01) |

(52) U.S. Cl.
USPC ..... 102/202.7; 102/209

(58) Field of Classification Search
USPC ..... 102/202.7, 204, 209, 251
See application file for complete search history.

(56) References Cited

U.S. PATENT DOCUMENTS

| | | | | |
|---|---|---|---|---|
| 3,861,312 | A * | 1/1975 | Held et al. | 102/208 |
| 5,238,204 | A * | 8/1993 | Metz | 244/3.15 |
| 7,316,186 | B1 * | 1/2008 | Robinson et al. | 102/251 |
| 7,849,798 | B2 * | 12/2010 | Robinson et al. | 102/251 |
| 2010/0282106 | A1 * | 11/2010 | Robinson et al. | 102/206 |
| 2013/0181459 | A1 * | 7/2013 | Rastegar et al. | 290/1 A |
| 2013/0193896 | A1 * | 8/2013 | Lynn et al. | 318/490 |

* cited by examiner

*Primary Examiner* — Michael David
(74) *Attorney, Agent, or Firm* — Seyfarth Shaw LLP; Brian Michaelis

(57) ABSTRACT

A pyrotechnic electrical generator including an initiator charge mechanism, one or more field poles and an armature that creates a magnetic field, and a coil that produces an electric current is disclosed herein. The armature is positioned within a bore extending through the one or more field poles, and the initiator charge mechanism is positioned in proximity to the armature. The initiator charge mechanism when activated creates a pressure that drives the armature from one end of the bore to the other end of the bore. As the armature travels through the field poles, it creates an alternating magnetic flux in the field poles inducing an alternating current in the coil. The coil then carries the current to a storage device, for example a capacitor and/or battery, or applies the current to one or more other devices as an ignition charge.

10 Claims, 3 Drawing Sheets

PYROTECHNIC ELECTRIC GENERATOR

FIELD

The present disclosure relates to electrical generators. More specifically, the present disclosure relates to power generators.

BACKGROUND

Time delay elements are widely used in various applications to ignite or detonate an explosive device after a time delay. One example of a time delay element is a pyrotechnic time delay element. In general, pyrotechnic time-delays use combustion of a pyrotechnic composition, such as delay composition, to impose a time delay in transferring energy from one location to another. These pyrotechnic time-delays are dependant upon the controlled combustion of the delay composition. This dependency upon the controlled combustion of the delay composition can present various issues.

In general, the controlled combustion of the delay composition may be compromised by, for example, inconsistent particle size distribution, and inadequate mixing of the delay composition. Based on the delay composition used, the shelf life of the pyrotechnic time-delay may be limited. Further, the operation of the pyrotechnic time-delay may be susceptible to damage from environmental factors, such as humidity, temperature, vibration, shock, and acceleration. The accuracy of the pyrotechnic time-delay is limited to ±25%.

In another field of endeavor, a popular electrical generator is a thermal battery. In general, thermal batteries produce electrical power through pyrotechnic heating of an anode component, a cathode component, and an electrolyte component of a chemical battery. Thermal batteries are non-rechargeable, single use batteries that are inert before being activated. Thermal batteries also tend to be limited in the amount of output or electrical power that can be generated. In general, these thermal batteries become spent or lose the ability to produce electrical power after a short period of time and upon cooling. Because of this loss of electrical power output, thermal batteries may not be used where power events are widely spaced apart, instead separate batteries are used to power each event. Thermal batteries are typically designed to provide particular power profiles, for example, low current, long power life, high current, and short power life, which leads to multiple batteries per system.

SUMMARY

A pyrotechnic electrical generator is disclosed herein. In general, the pyrotechnic electrical generator is an electromechanical power generator driven by a pyrotechnic charge, for example a pyrotechnic initiator, squib, or primer. In an illustrative embodiment, the pyrotechnic electrical generator includes two field poles, a magnetic armature, a coil, and a pyrotechnic charge. The pyrotechnic charge creates a pressure that exerts a force on and drives the magnetic armature through the field poles generating an alternating magnetic flux in the field poles, generating an alternating current in the coil. Activation of the pyrotechnic electrical generator typically occurs within less than about ten milliseconds after the initiator, squib, or primer is fired. The coil carries the current to a storage device, for example a capacitor and/or battery, or the coil applies the current to one or more other devices.

In an illustrative embodiment, the pyrotechnic electrical generator includes a stator, a bore, an armature, and an initiator charge mechanism. The bore runs through the stator and includes a first end and a second end. The armature is positioned within the bore, and the initiator charge mechanism is configured on the first end of the bore to drive the armature through the bore from the first end to the second end to develop an ignition charge.

The pyrotechnic electrical generator may further include a coil form having a first end and a second end, wherein the first end of the coil form closes the second end of the bore. A coil may be wrapped around the coil form between the first end and the second end of the coil form.

In another illustrative embodiment, a time delay unit is disclosed herein. The time delay unit includes a housing, a stator, an armature, a pyrotechnic charge, and an output detonator. The housing has an input end and an output end. The stator is positioned within the housing. The bore has a first end and a second end running through the stator, wherein the first end of the bore is proximal to the input end of the housing. The armature is positioned within the bore. The pyrotechnic charge is positioned in the input end of the housing, and is configured to drive the armature through the bore from the first end to the second end creating an electrical current. The output detonator includes a time delay circuit and is positioned within the output end of the housing. The output detonator is configured to receive the electrical current.

In another illustrative embodiment, a method for generating an ignition charge is disclosed herein. The method includes activating an initiator charge. The activated initiator charge creates a force that drives an armature through a stator. An electrical current is then generated by the armature being driven through the stator. The electrical current is then passed to an electrical device via a coil.

In yet another illustrative embodiment, a programmable pyrotechnic electrical generator for use as a battery, is disclosed herein. In general the pyrotechnic electrical generator replaces single or multiple thermal batteries in a portable system. Instead of using pyrotechnics to heat a chemical battery, the pyrotechnic electrical generator disclosed herein uses gas pressure produced by pyrotechnics to drive a single stage turbine that drives an alternating current generator. The gas pressure is produced in one or more gas generators in the pyrotechnic electrical generator, each generator being capable of being operated individually, or simultaneously with other generators. This allows the gas generator to be tailored to produce the proper gas flow and quantity for the required power needed at a specific time.

An example of an application of the pyrotechnic electrical generator is as an ordnance sequencer for an aircraft ejection seat. At the time of ejection, a first gas generator is fired, producing a fast rising high current pulse to power a sequencer logic and fire a first of three ordnance events. After about three minutes, a second gas generator is fired producing a high current pulse which in turn fires a last of three ordnance events. Depending on the application, the firing pulses for the gas generators may be externally applied or if the time profile is known, an electronic sequencer/firing circuit could be incorporated into the pyrotechnic electrical generator.

An advantage of the pyrotechnic electrical generators disclosed herein is that the pyrotechnic electrical generators require no maintenance and can have a useful shelf life of about thirty (30) years or longer. Another advantage of the pyrotechnic electrical generators is that the pyrotechnic electrical generators are capable of withstanding extreme levels of shock, vibration, and acceleration under a wide range of temperature and other environmental conditions. The pyrotechnic electrical generators can be used as a power source when a sudden short demand in electrical energy is needed. Additionally, the pyrotechnic electrical generators can be used to power an electronic time delay element that may be used in various applications to ignite or detonate an explosive device. The accuracy of the electronic time delay can be less than ±1%.

BRIEF DESCRIPTION OF THE DRAWINGS

The pyrotechnic electrical generators disclosed herein are illustrated in the figures of the accompanying drawings which are meant to be exemplary and not limiting, in which like references are intended to refer to like or corresponding parts, and in which.

DETAILED DESCRIPTION

Detailed embodiments of pyrotechnic electrical generators and methods associated therewith are disclosed herein, however, it is to be understood that the disclosed embodiments are merely exemplary of the pyrotechnic electrical generators, which may be embodied in various forms. Therefore, specific functional details disclosed herein are not to be interpreted as limiting, but merely as a basis for the claims and as a representative basis for teaching one skilled in the art to variously employ the disclosure.

Figure 1:
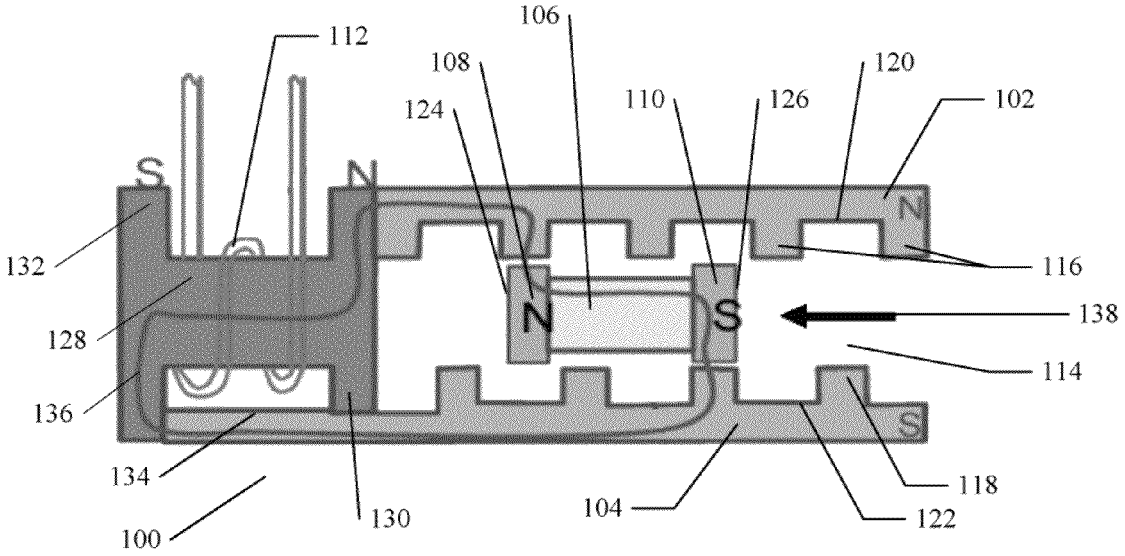
FIG. 1 illustrates an embodiment of a pyrotechnic electrical generator.

A pyrotechnic electrical generator according to an illustrative embodiment is described with reference to FIG. 1. As illustrated in FIG. 1, the pyrotechnic electrical generator 100 includes at least two field poles including at least one North (N) magnetic pole 102 and at least one South (S) magnetic pole 104 or a stator, a magnetic armature 106 with at least two poles including at least one North (N) magnetic pole 108 and at least one South (S) magnetic pole 110, and a coil 112. As illustrated, the field poles 102 and 104 are positioned and/or aligned with respect to one another forming a bore 114. The bore 114 is configured to receive and allow the armature 106 to slide through the bore 114. As the armature 106 slides through the bore 114, the poles 108 and 110 of the armature 106 alternately align with each of the field poles 102 and 104 creating an alternating magnetic flux in the field poles 102 and 104. This alternating magnetic flux is passed through the coil 112 creating an alternating current.

As illustrated, the armature 106 is at least one permanent magnet, and in this embodiment is illustratively a neodymium/iron/boron rare earth magnet(s). It should be appreciated by those of ordinary skill in the art that the armature magnet(s) may be a magnet(s) of various other magnetic materials, such as, but not limited to, iron, iron alloys, nickel, nickel alloys, cobalt, cobalt alloys, alnico alloys, neodymium/iron/boron alloys, samarium/cobalt alloys, platinum/cobalt alloys, and other magnetic materials and alloys of the type. In an illustrative embodiment, each of the field poles 102 and 104 may further include one or more protrusions 116 and 118, respectively, positioned on inner surfaces 120 and 122, respectively, of the field poles 102 and 104. As illustrated, there are five (5) protrusions 116 equally spaced along the inner surface 120 of the field pole 102, and four (4) protrusions 118 equally spaced along the inner surface 122 of the opposite polarity field pole 104. It should be appreciated by those of ordinary skill in the art that the number of protrusions 116 and 118 may be greater than or less than the number illustrated.

In an illustrative embodiment, the protrusions 116 and 118 of the field poles 102 and 104, respectively, may be offset with respect to one another. As illustrated, the protrusions 118 of the field pole 104 are offset with respect to the protrusions 116 of the field pole 102, and positioned to align with gaps between the protrusions 116 of the field pole 102.

In an illustrative embodiment, the armature 106 is positioned within the bore 114 between the field poles 102 and 104 and creates the magnetic field. As illustrated, the armature 106 is oriented normal or perpendicular to the field poles 102 and 104, and is configured to move along a linear path within the bore 114 formed by the field poles 102 and 104.

As illustrated, the pole 108 of the armature 106 is a N magnetic pole and is positioned on a first end 124 of the armature 106. The pole 110 of the armature 106 is a S magnetic pole and is positioned on a second end 126 of the armature 106. It should be appreciated by those of ordinary skill in the art that the pole 108 may be a S magnetic pole and the pole 110 may be a N magnetic pole. Further, it should be appreciated by those of ordinary skill in the art that the armature 106 may be an electromagnet.

In an illustrative embodiment, the coil 112 is wrapped around a magnetic coil form 128. The coil form 128 is positioned to contact the field poles 102 and 104 and close one end of the bore 114 between the field poles 102 and 104. As illustrated, the coil form 128 includes at least one N magnetic pole on a first end 130, and at least one S magnetic pole on a second end 132. It should be appreciated by those of ordinary skill in the art that the first end 130 may include a S magnetic pole and the second end 132 may include a N magnetic pole.

As illustrated, the coil 112 is positioned between the first end 130 and the second end 132 of the coil form 128. Further, the first end 130 is shorter in length than the second end 132 of the coil form 128. This allows for the first end 130 of the coil form 128 to connect to and interact with the field pole 102, and the second end 132 of the coil form 128 to connect to and interact with the field pole 104. The field pole 104 includes an extension 134 that extends beyond the first end 130 of the coil form 128, under the first end 130 of the coil form 128, and connects to and interacts with the second end 132 of the coil form 128. These connections and interactions allow for a magnetic flux line, illustrated as 136, to pass through at least a portion of the field pole 102, the pole 108 of the armature 106, the pole 110 of the armature 106, the field pole 104, the second end 132 of the coil form 128, the first end 130 of the coil form 128, and the field pole 102.

In an illustrative embodiment, the pyrotechnic electrical generator 100 includes a pyrotechnic initiation charge, for example, an initiator, primer, or squib configured to connect to the pyrotechnic electrical generator 100 at one end of the bore 114 opposite or distal to the coil form 128. The pyrotechnic initiator charge, when activated, creates a pressure that exerts a force, illustrated as arrow 138, and drives the armature 106 through the field poles 102 and 104 from one end of the bore 114 toward the opposite end of the bore 114 or the coil form 128, where it stops. As the armature's 106 magnetic field travels through the field poles 102 and 104 a current or voltage is generated in coil 112. The coil 112 may then carry the current to a storage device, for example a capacitor and/or battery, or apply the current directly to one or more other devices. The pyrotechnic initiator charge may be activated electrically or by percussion.

In an illustrative embodiment, the pole geometry of the pyrotechnic electrical generator 100 focuses the magnetic field and converts the linear motion of the armature 106 into a current source. The armature 106 driven by the pyrotechnic initiator charge can achieve a high velocity, for example, about 100 ft/sec to about 1000 ft/sec, to generate the voltage. The voltage generated by the pyrotechnic electrical generator 100 is inversely proportional to transit time. Accordingly, the pyrotechnic initiator charge may be controlled to control the voltage or current generated by the pyrotechnic electrical generator disclosed herein.

As illustrated, the field pole 102 is a N magnetic pole and the field pole 104 is a S magnetic pole 104. However, it should be appreciated by those of ordinary skill in the art that the field pole 102 may be a S magnetic pole and the field pole 104 may be a N magnetic pole.

Figure 2:
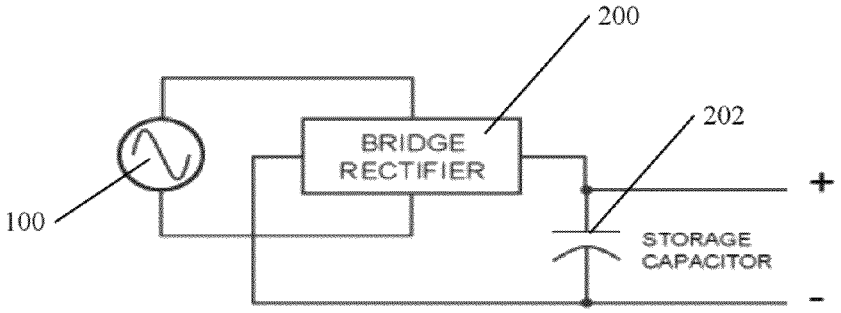
FIG. 2 illustrates a functional schematic of the pyrotechnic electrical generator.

A functional schematic according to an illustrative embodiment is described with reference to FIG. 2. As illustrated in FIG. 2, the current generated by the pyrotechnic electrical generator 100 is an Alternating Current (AC). The current may be passed from the coil 112 through a bridge rectifier 200 to convert the AC to a Direct Current (DC). The resulting DC may then be passed to one or more storage capacitors or a capacitor bank 202 and stored as an ignition charge.

In an illustrative embodiment, the pyrotechnic electrical generator may include an outer housing configured to contain or surround the various components described above. The pyrotechnic electrical generator may also include an input plug and an output plug configured to connect to the housing. The input plug may contain a primer and a pyrotechnic initiator charge that drives the armature to develop the ignition charge. The output plug may contain an output initiator or detonator as well as a digital time delay circuit.

In an illustrative embodiment, the pyrotechnic electrical generator may be used as a battery in short duration applications, for example, applications that are about two seconds or less. These applications may include a remotely electrically switched pyrotechnical valve for ordnance transfer lines, and a power supply for remote sensors.

Figure 3:
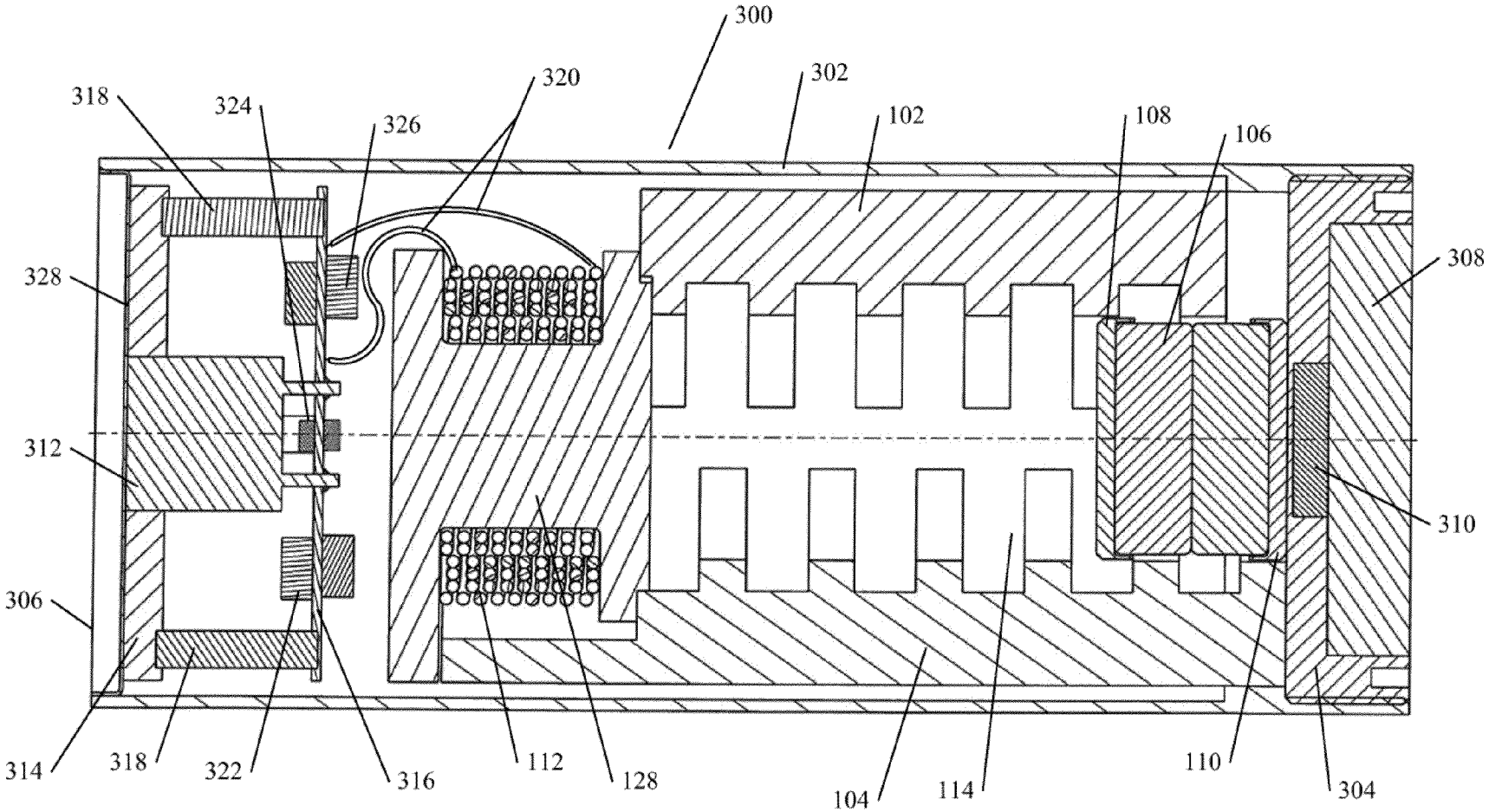
FIG. 3 illustrates a sectional view of an embodiment of a pyrotechnic electrical generator used in a digital time delay.

A pyrotechnic electrical generator for use as a time delay unit according to an illustrative embodiment is described with reference to FIG. 3. As illustrated in FIG. 3, the pyrotechnic electrical generator 300 includes the two field poles 102 and 104, the magnetic armature 106 with the two poles 108 and 110, and the coil 112 wrapped around the coil form 128, as described above with reference to FIG. 1. The pyrotechnic electrical generator 300 also includes an outer housing 302, an input plug/barrier 304 connected to a first end of the outer housing 302, and an output plug 306 connected to a second end of the outer housing 302. In this illustrative embodiment, the input plug 304 and the output plug 306 are connected to the first end and the second end, respectively, of the outer housing 302 by tungsten inert gas (TIG) welding.

The input plug 304 may contain a percussion primer 308 with a pyrotechnic booster charge 310 configured to drive the armature 106. In other illustrative embodiments, the armature may be driven by an external pressure activated piston/primer that can be used to activate the pyrotechnic booster charge 310, or by an electrical initiator that replaces the primer 308.

The output plug 306 includes an output initiator or detonator 312 mounted on an output bulkhead 314, for example, by TIG welding. The output initiator or detonator 312 is configured to receive the current generated by the pyrotechnic electrical generator 300 and activate a detonator head and output charge of the output initiator or detonator 312. The output bulkhead 314 may have printed wiring boards 316 connected or secured to the output bulkhead 314 by one or more spacers 318. The printed wiring boards 316 are electrically connected to the coil 112 of the pyrotechnic electrical generator 300 by coil leads 320. One or more time delay circuits and/or storage capacitors may be electrically connected to the printed wiring boards 316.

In an illustrative embodiment, the output bulkhead 314 includes a time delay circuit for use in providing a time delay in the activation of the output initiator or detonator 312. As illustrated, the output bulkhead 314 includes a timer integrated circuit (IC) 322 including an oscillator and counter, and a timer component resistor 324. The timer IC 322 and the timer component resistor 324 are connected to the printed wiring boards 316.

In an illustrative embodiment, the output bulkhead 314 includes a storage capacitor 326 connected to the printed wiring boards 316. A cup closure 328 seals the detonator 312 and output bulkhead 314 of the output plug 306. The cup closure 328 may be a stainless steel cup closure and may be, for example, TIG welded to the outer housing 302 of the pyrotechnic electrical generator 300 to hermetically seal the detonator 312 and output bulkhead 314 within the pyrotechnic electrical generator 300. The output plug 306 may also include one or more external connectors for connecting the pyrotechnic electrical generator to one or more electrical devices.

Activation of the pyrotechnic electrical generator typically occurs within less than about a hundred milliseconds after the initiator, squib, or primer is fired. Activation is initiated by a common cartridge primer or an electrically fired initiator or a pressure activated piston/primer and then boosted by a charge of hi-temp cyclotrimethylenetrinitramine (RDX also known as cyclonite) or other pyrotechnic powder.

Upon activation, the primer 308 and/or the pyrotechnic booster charge 310 creates a pressure that exerts a force that drives the armature 106 through the field poles 102 and 104 from one end of the bore 114 toward the opposite end of the bore 114 or the coil form 128, where it stops. As the armature's 106 magnetic field travels through the field poles 102 and 104 a current or voltage is generated in coil 112. The coil 112 may then pass the current to the storage capacitor 326 via the coil leads 320, and/or pass the current to the timer IC 322 and the timer component resistor 324 via the coil leads 320.

When the current is stored in the storage capacitor 326, the current may be thereafter passed to the timer IC 322 and the timer component resistor 324 at a later time. When the current is passed to the timer IC 322 and the timer component resistor 324, the timer IC 322 and the timer component resistor 324 may delay the application of or directly pass the current to the output initiator or detonator 312. The output initiator or detonator 312 may then pass the current to the detonator head and/or output charge activating the detonator head and/or output charge.

In an illustrative embodiment, the detonator head is a platinum bridgewire with Lead Styphnate slurry, in which all-fire is about 0.3 amps and no-fire is about 0.1 amps. The output charge of the detonator may be either pentaerythritol tetranitrate (PETN) or cyclotrimethylenetrinitramine (RDX). In another illustrative embodiment, a reactive bridge configuration may be used in the detonator head, for example, as described in commonly owned co-pending U.S. patent application Ser. No. 13/456,318, entitled REACTIVE BRIDGE ELECTRO-EXPLOSIVE DEVICES, filed Apr. 26, 2012, the contents of which are hereby incorporated by reference in their entirety. The reactive bridge may be a vapor deposited sandwich of aluminum and palladium or other reactive materials.

In an illustrative embodiment, the pyrotechnic electrical generator 300 using the percussion primer initiation of existing time delays, can reduce the time variability from about ±25% to about ±0.5% when compared to known pyrotechnic time delays.

Figure 4:
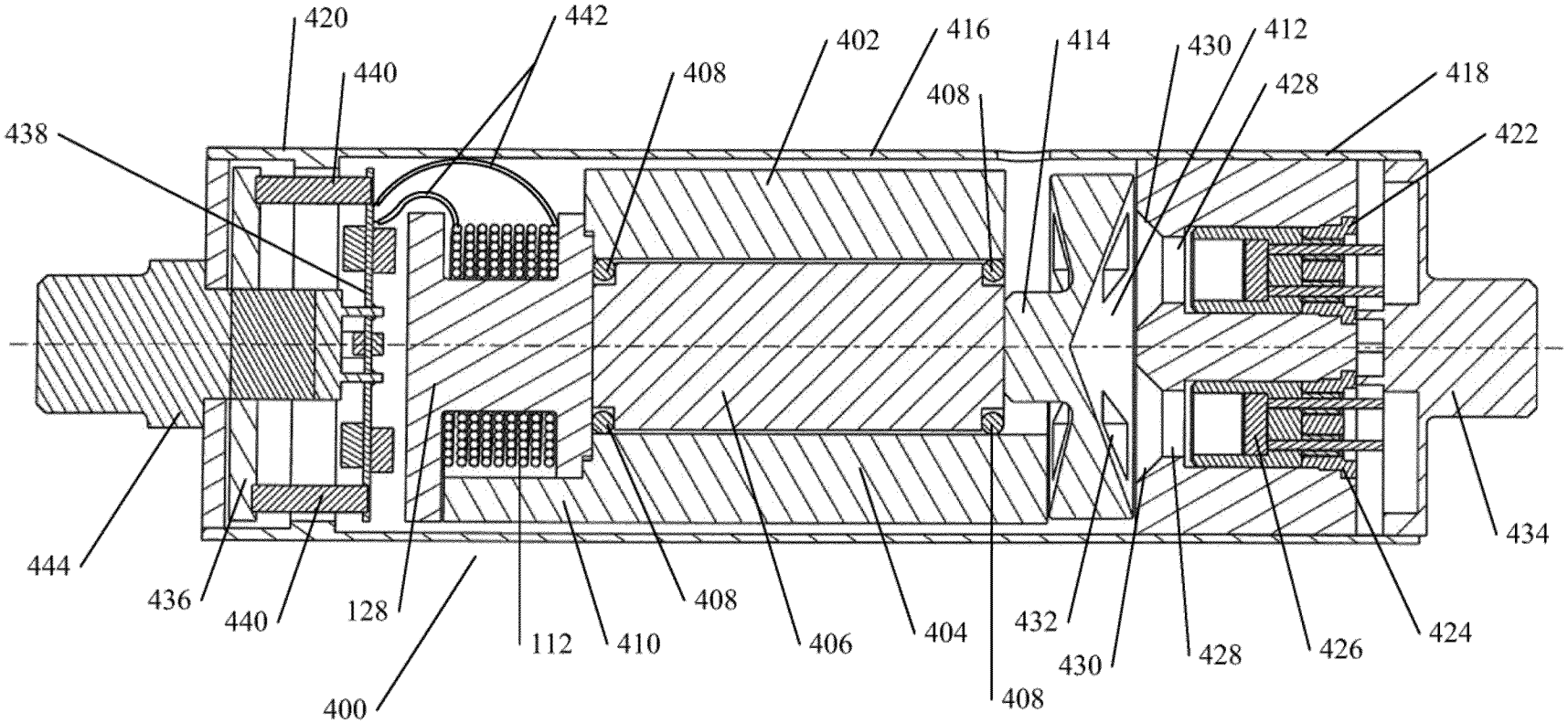
FIG. 4 illustrates a sectional view of an embodiment of a pyrotechnic electrical generator for use as a battery.

A pyrotechnic electrical generator for use as a battery according to an illustrative embodiment is described with reference to FIG. 4. As illustrated in FIG. 4, the pyrotechnic electrical generator 400 includes a stator having a first stator pole 402 and a second stator pole 404, an armature 406, and the coil 112 wrapped around the coil form 128, as described above with reference to FIG. 1. The first stator pole 402 and the second stator pole 404 are positioned and/or aligned with respect to one another forming a bore. The bore is configured to receive and allow the armature 406 to rotate within the bore. The armature 406 may be diametrically magnetized with N poles and S poles. As the armature 406 rotates within the bore, the armature 406 magnetizes the first stator pole 402 and the second stator pole 404 creating an alternating magnetic flux in the first stator pole 402 and the second stator pole 404. This alternating magnetic flux is passed through the coil form 128 to the coil 112 creating an alternating current.

The coil form 128 is positioned to contact the first stator pole 402 and the second stator pole 404 and close one end of the bore between the first stator pole 402 and the second stator pole 404. Similar to the field pole 104 described above, first stator pole 402 connects to and interacts with the coil form 128, and the second stator pole 404 includes an extension 410 that connects to and interacts with the coil form 128. These connections and interactions allow for the magnetic flux to pass through the stator to the coil form 128 and the coil 112.

The pyrotechnic electrical generator 400 includes one or more bearings 408 supporting the armature 406 within the bore created by the stator. The bearings 408 are located between the armature 406 and the stator and are configured to allow the armature 406 to rotate with respect to the stator. The pyrotechnic electrical generator 400 also includes a turbine 412 and a shaft 414 that connects to the armature 406 at an end opposite the coil form 112.

The pyrotechnic electrical generator 400 also includes an outer housing 416 having an input end 418 and an output end 420. The outer housing 416 is configured to encase or hold the components of the pyrotechnic electrical generator 400. As illustrated, a first gas generator 422 and a second gas generator 424 are disposed in the input end 418 of the outer housing 416. The first gas generator 422 and the second gas generator 424 may be connected to the outer housing 416 by tungsten inert gas (TIG) welding. The first gas generator 422 and the second gas generator 424 may each include a header 426. The headers 426 may be bridgewire headers that when current is passed thorough the bridge, ignite and produce gas pressure. In an illustrative embodiment, the headers 426 are a platinum bridgewire with Lead Styphnate slurry, in which all-fire is about 0.3 amps and no-fire is about 0.1 amps. In another illustrative embodiment, a reactive bridge configuration may be used in the headers 426, for example, as described in commonly owned co-pending U.S. patent application Ser. No. 13/456,318, entitled REACTIVE BRIDGE ELECTRO-EXPLOSIVE DEVICES, filed Apr. 26, 2012, the contents of which are hereby incorporated by reference in their entirety. The reactive bridge may be a vapor deposited sandwich of aluminum and palladium or other reactive materials that when current is passed thorough the reactive bridge, ignite and produce gas pressure.

The gas pressure produced by the headers 426 may be channeled through channels 428 to the turbine 412 and the shaft 414 which in turn rotates the armature 406 to produce an alternating current. The channels 428 may include a chamfer 430 at an end proximate the turbine 412 to direct the gas pressure onto the turbine 412. The turbine 412 may also include one or more blades 432 proximate the channels 428 configured to receive the gas pressure and rotate the turbine.

An input connector 434 may be disposed on the input end 418 of the outer housing 416 of the pyrotechnic electrical generator 400, for example, by tungsten inert gas (TIG) welding. The input connector 434 may close the input end 418 of the outer housing 416. The input connector 434 is connected to the headers 426 within the outer housing 416, and is configured to connect to an external power supply and receive a current, for example, a feed current, from the external power supply to ignite the headers 426 and produce the gas pressure. Alternatively, internal firing circuits may be used to ignite the headers 426 and produce the gas pressure.

An output bulkhead 436 may be disposed in the output end 420 of the outer housing 416 of the pyrotechnic electrical generator 400, for example, by tungsten inert gas (TIG) welding. The output bulkhead 436 may have one or more printed wiring boards or circuit boards 438 connected or secured to the output bulkhead 436 by one or more spacers 440. The circuit board 438 is electrically connected to the coil 112 of the pyrotechnic electrical generator 400 by coil leads 442. The circuit board 438 may contain components that rectify and filter the alternating current to produce a direct current, as described above. The circuit board 438 may also contain logic and one or more firing circuits to initiate the first gas generator 422 and the second gas generator 424, for example, the circuit board 438 may contain one or more time delay circuits, and/or one or more storage capacitors, as described above. The spacers 440 and the output bulkhead 436 provide support for the circuit board 438 and the components of the circuit board 438.

An output connector 444 may be disposed on the output end 420 of the outer housing 416 of the pyrotechnic electrical generator 400, for example, by tungsten inert gas (TIG) welding. The output connector 444 may close the output end 420 of the outer housing 416. The output connector 444 is connected to the circuit board 438, and includes an output connection and/or circuit connections configured to connect to one or more external electrical devices. The output connector 444 is configured to receive the current generated by the pyrotechnic electrical generator 400 and pass the current to the one or more external electrical devices.

Activation of the pyrotechnic electrical generator 400 typically occurs within less than about a hundred milliseconds after the headers 426 are fired. Upon activation, the headers 426 create gas pressure that exerts a force on the turbine 412 that rotates the armature 406. As the armature 406 rotates within the bore, the armature 406 magnetizes the first stator pole 402 and the second stator pole 404 creating an alternating magnetic flux in the first stator pole 402 and the second stator pole 404. This alternating magnetic flux is passed through the coil form 128 to the coil 112 creating an alternating current. The coil 112 passes the current to circuit board 438 which changes the alternating current to a direct current and passes the direct current to one or more storage capacitor via the coil leads, passes the current to a time delay circuit, and/or passes the current to the output connector 444, which can apply the current to one or more external electrical devices.

The armature 406 may be at least one permanent magnet, and in this embodiment is illustratively a neodymium/iron/boron rare earth magnet(s). It should be appreciated by those of ordinary skill in the art that the armature magnet(s) may be a magnet(s) of various other magnetic materials, such as, but not limited to, iron, iron alloys, nickel, nickel alloys, cobalt, cobalt alloys, alnico alloys, neodymium/iron/boron alloys, samarium/cobalt alloys, platinum/cobalt alloys, and other magnetic materials and alloys of the type.

Although the pyrotechnic electrical generator 400 is described as including two gas generator, it should be appreciated by those of ordinary skill in the art that more than two or less than two gas generators may be incorporated into the pyrotechnic electrical generator 400. Additionally, the gas generators may be fired at the same time, one at a time, in a predetermined sequence with a predetermined amount of time delay between firing of the gas generators, or in any other configuration.

In an illustrative embodiment, the pyrotechnic electrical generator(s) described herein can produce about 400 volts unloaded. Loaded, the pyrotechnic electrical generator(s), described herein, contain a significant amount of energy that is created over a period of time that allows for efficient energy transfer into storage capacitors or to other devices.

Materials used in the pyrotechnic electrical generator may be steel, for the coil form, field poles, armature pole pieces, copper magnet wire for the coil and neodymium/iron/boron rare earth magnets for the armature. Further, although certain components of the pyrotechnic electrical generator are described as being connected to one another by TIG welding, it should be appreciated by those of ordinary skill in the art that the components may be connected to one another using other methods or processes of the type.

In an illustrative embodiment, the input plug and the input connector, and the output plug and the output connector may be removably connected to the first or input end and the second or output end, respectively, of the outer housing allowing the input plug and the input connector, and the output plug and the output connector to be changed or replaced. The output initiator or detonator and the headers may also be removably mounted within the outer housing allowing the output initiator or detonator and the headers to be changed or replaced. Further, the cup closure or stainless steel cup closure may be removably sealed to or connected to the outer housing of the pyrotechnic electrical generator allowing the cup closure to be removed. The pyrotechnic electrical generators may be configured to provide access to the components of the pyrotechnic electrical generators, for example, the output initiator or detonator, the printed wiring boards or circuit boards, the time delay circuit, the storage capacitor, and other components.

Although the pyrotechnic electrical generators described with reference to FIGS. 1 and 3 are described as including the armature that moves along the linear path within the bore formed by the field poles and the associated components, it should be appreciated by those of ordinary skill in the art that the pyrotechnic electrical generators described with reference to FIGS. 1 and 3 may alternatively include the armature that rotates within the stator poles and the associated components as described with reference to FIG. 4. Further, although the pyrotechnic electrical generator described with reference to FIG. 4 is described as including the armature that rotates within the stator poles and the associated components, it should be appreciated by those of ordinary skill in the art that the pyrotechnic electrical generator described with reference to FIG. 4 may alternatively include the armature that moves along the linear path within the bore formed by the field poles and the associated components, as described with reference to FIGS. 1 and 3.

Although the pyrotechnic electrical generator has been described and illustrated in connection with certain embodiments, many variations and modifications will be evident to those skilled in the art and may be made without departing from the spirit and scope of the disclosure. The disclosure is thus not to be limited to the precise details of methodology or construction set forth above as such variations and modification are intended to be included within the scope of the disclosure. Moreover, unless specifically stated any use of the terms first, second, etc. do not denote any order or importance, but rather the terms first, second, etc. are merely used to distinguish one element from another.

What is claimed is:

1. A pyrotechnic electrical generator, comprising:

a stator;

a bore having a first end and a second end running through said stator;

an armature positioned within said bore; and an initiator charge mechanism configured on said first end of said bore to drive said armature through said bore from said first end to said second end to develop an ignition charge.

2. The pyrotechnic electrical generator according to claim 1, wherein said armature includes a first pole and a second pole, said second pole having a polarity opposite said first pole.

3. The pyrotechnic electrical generator according to claim 2, wherein said armature is a permanent magnet.

4. The pyrotechnic electrical generator according to claim 1, further comprising a coil form having a first end and a second end, said first end of said coil form closing said second end of said bore.

5. The pyrotechnic electrical generator according to claim 4, further comprising a coil wrapped around said coil form between said first end and said second end of said coil form.

6. The pyrotechnic electrical generator according to claim 4, wherein said stator includes a first field pole and a second field pole, said second field pole having a polarity opposite said first field pole.

7. The pyrotechnic electrical generator according to claim 6, wherein said first field pole is offset with respect to said second field pole.

8. The pyrotechnic electrical generator according to claim 6, wherein said first end of said coil form is configured to interact with said first field pole, and said second end of said coil form is configured to interact with said second field pole.

9. The pyrotechnic electrical generator according to claim 5, further comprising a storage capacitor configured to receive said ignition charge from said coil.

10. The pyrotechnic electrical generator according to claim 5, further comprising a detonator configured to receive said ignition charge from said coil.

* * * * *